US010752410B2

(12) United States Patent
Coloneri

(10) Patent No.: US 10,752,410 B2
(45) Date of Patent: Aug. 25, 2020

(54) CONTAINER LID AND VALVE INCLUDING A LOCKING MECHANISM

(71) Applicant: Antonio F. Coloneri, Stony Brook, NY (US)

(72) Inventor: Antonio F. Coloneri, Stony Brook, NY (US)

( * ) Notice: Subject to any disclaimer, the term of this patent is extended or adjusted under 35 U.S.C. 154(b) by 0 days.

(21) Appl. No.: 16/701,932

(22) Filed: Dec. 3, 2019

(65) Prior Publication Data

US 2020/0172305 A1 Jun. 4, 2020

Related U.S. Application Data

(60) Provisional application No. 62/775,075, filed on Dec. 4, 2018.

(51) Int. Cl.
*B65D 47/20* (2006.01)
*B65D 51/16* (2006.01)
*B65D 51/24* (2006.01)

(52) U.S. Cl.
CPC ..... *B65D 47/2056* (2013.01); *B65D 51/16* (2013.01); *B65D 51/24* (2013.01)

(58) Field of Classification Search
CPC ..... B65D 47/2056; B65D 47/2062; B65D 47/0823; B65D 2543/00046; B65D 43/0202; A47G 19/2272
USPC ..... 220/713, 254.5
See application file for complete search history.

(56) References Cited

U.S. PATENT DOCUMENTS 3,972,443 A * 8/1976 Albert ..... A47G 19/2272 220/715
4,133,446 A * 1/1979 Albert ..... A47G 19/2272 220/254.5
5,485,938 A * 1/1996 Boersma ..... A47G 19/2272 220/254.5
2010/0059535 A1* 3/2010 Syrkos ..... B65D 43/0212 220/714

* cited by examiner

*Primary Examiner* — Jeffrey R Allen
(74) *Attorney, Agent, or Firm* — Preti Flaherty Beliveau & Pachios LLP

(57) ABSTRACT

A container lid for a fluid container of a resilient deformable material includes a body member having a drinking aperture; an actuator coupled to the body member via an area surrounding the actuator; and a valve. The lid has a first stable and a second stable state in which the area surrounding the actuator in generally inverted from the first stable state. Upon application of a first force to the top surface of the actuator when in the first stable state, the actuator temporarily deflects the valve to unseal the drinking aperture and upon removal of the first force the valve reseals the drinking aperture and both the actuator and the lid reassume the first stable state. Upon application of a second force to the actuator sufficiently greater than the first force, the lid assumes the second stable state in which the drinking aperture remains unsealed.

22 Claims, 9 Drawing Sheets

SECTION AA FREE STATE, SEALED POSITION.

SECTION AA ACTUATOR LOCKED IN VALVE OPEN POSITION.

SECTION AA FREE STATE, SEALED POSITION.

SECTION AA ACTUATOR LOCKED IN VALVE OPEN POSITION.

1600

STRAW SIPPING, ALTERNATE DESIGN

CONTAINER LID AND VALVE INCLUDING A LOCKING MECHANISM

STATEMENT REGARDING FEDERALLY SPONSORED RESEARCH OR DEVELOPMENT

Not Applicable

BACKGROUND

The present disclosure relates to a container lid configured for coupling to an open top fluid container and, more specifically, to a container lid having a valve configured to temporarily unseal and reseal a drinking aperture formed in the container lid, wherein the valve may also be secured in a position in which the drinking aperture remains unsealed.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Plastic disposable lids for mounting to open top fluid containers, such as coffee cups, are well-known in the art. Such lids are intended to avoid undesired spillage of a liquid due to accidental tipping of the cup or jostling during transit. While spillage of a beverage from a fluid container is almost always undesirable, when the beverage is a hot beverage such as coffee or tea, spillage can also present a safety hazard and can result in serious burns.

Container lids are known in the art that include a valve configured to temporarily unseal a drinking aperture.

While it is desirable for a drinking aperture to be unsealed temporarily while drinking from the fluid container to avoid inadvertent spillage, it would be desirable for a user to be able to also secure the valve in the unsealed orientation.

SUMMARY

The below summary is merely representative and non-limiting.

The above problems are overcome, and other advantages may be realized, by the use of the embodiments.

In a first aspect, an embodiment provides an improved container lid for a fluid container having a fluid container rim. The container lid includes a body member or container lid cover and a valve that serves to unseal and seal a drinking aperture in the body member. The body member includes a peripheral lip around the circumference of the body member. The peripheral lip includes an inward facing concave surface that is cooperative with the rim of a drinking container, such as the rim of a paper coffee cup, to secure the container lid to the drinking container upon urging of the lip over the rim of the drinking container. The body member includes a top surface, a bottom surface, an actuator or button and the drinking aperture which is adjacent the periphery of the body member. In response to the application of a manual downward force to the actuator by a user from the top surface of the body member, a bottom surface of the actuator abuts the valve and deflects the valve downward to unseal the drinking aperture as subsequently described.

The body member lid and the valve are formed of a resilient deformable material and the valve is disposed in confronting relation with the bottom surface of the body member.

In a further embodiment, the valve extends from a first end portion that is secured to the bottom surface of the body member to a second end portion that includes a sealing member. In the first embodiment the valve is formed as a distinct and separate piece from the body member and is secured to the bottom surface of the body member. In a free state in which no downward force is applied to the actuator, the sealing member is sprung upward towards the drinking aperture and generally occludes the drinking aperture to generally seal the aperture and prevent fluid flow therethrough. Upon the application of a first mild downward force to the actuator from the top surface of the body member, the bottom surface of the actuator abuts an intermediate portion of the valve between the first end portion and the second end portion causing the sealing member to deflect downward and away from the drinking aperture as to unseal the aperture to permit fluid flow therethrough. Upon removal of the first mild downward force, the sealing member returns to the free state in which the sealing member generally occludes and generally seals the drinking aperture.

The actuator is configured to be bi-stable. More specifically, upon the application of a first mild downward force to the top surface of the actuator from above the body member, the bottom surface of the actuator deflects downward from a free state position and abuts the intermediate portion of the valve which is disposed in confronting relation with the bottom surface actuator to downwardly deflect the intermediate portion and the second end portion that includes the sealing member. Downward deflection of the sealing member results in unsealing of the drinking aperture to permit fluid flow therethrough. Upon removal of the first mild downward force from the actuator, the actuator returns to the free state position in which the sealing member seals the drinking aperture due to the resilient nature of the valve.

The area surrounding the actuator is configured so that upon the application of a second sufficient downward manual force that is greater than the first mild downward force, the actuator snaps downward into a second valve engagement position and remains in this position. In the second valve engagement position the portion of the bottom surface of the actuator is disposed at a height lower than its original height and abuts and downwardly deflects the intermediate portion to deflect the sealing member downward so as not to occlude the drinking aperture. Once the area has snapped into the second valve engagement position, the valve remains locked in this position with the drinking aperture unsealed.

In another embodiment, an interconnection portion extends between the peripheral lip of the body member and the first end portion of the valve and the body member, the valve and the interconnection portion are formed as a one-piece, integral and continuous member. Apart from presence of the interconnection portion, the configuration and operation of the body member and the valve are as described hereinabove with respect to the first embodiment. The one-piece container lid may be formed in one or more molding, stamping, cutting and/or forming operations or otherwise formed to provide a one-piece continuous and integral member. After forming the one-piece container lid, the valve may be folded and formed so as to confront the bottom surface of the body member.

BRIEF DESCRIPTION OF THE DRAWINGS

Aspects of the described embodiments are more evident in the following description, when read in conjunction with the attached Figures.

DETAILED DESCRIPTION

Figure 1:
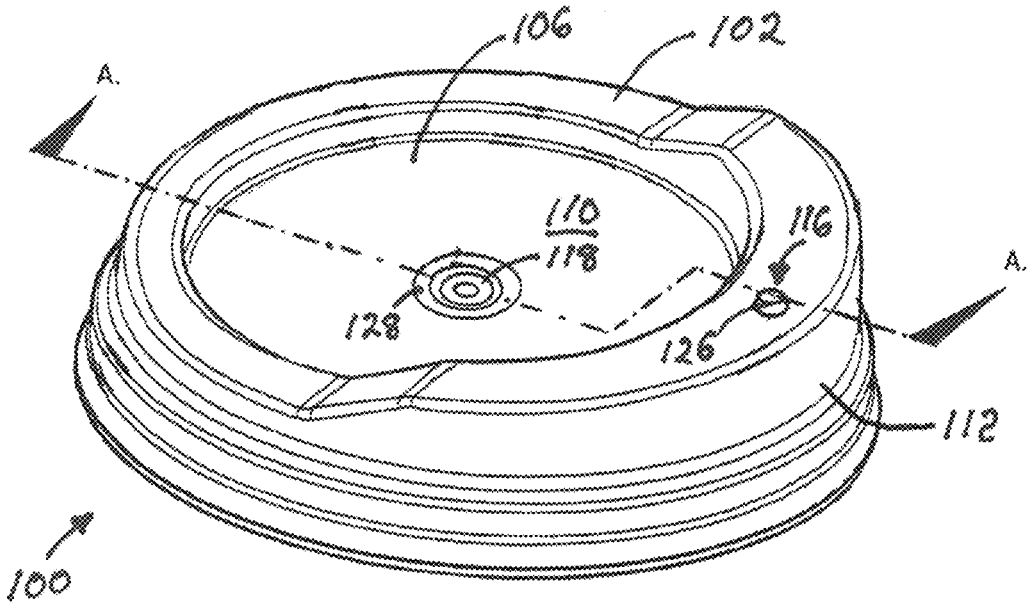
FIG. 1 is a top perspective view of a first embodiment of a container lid, the first embodiment having a two-piece design for the body member and valve of the container lid.
Figure 2:
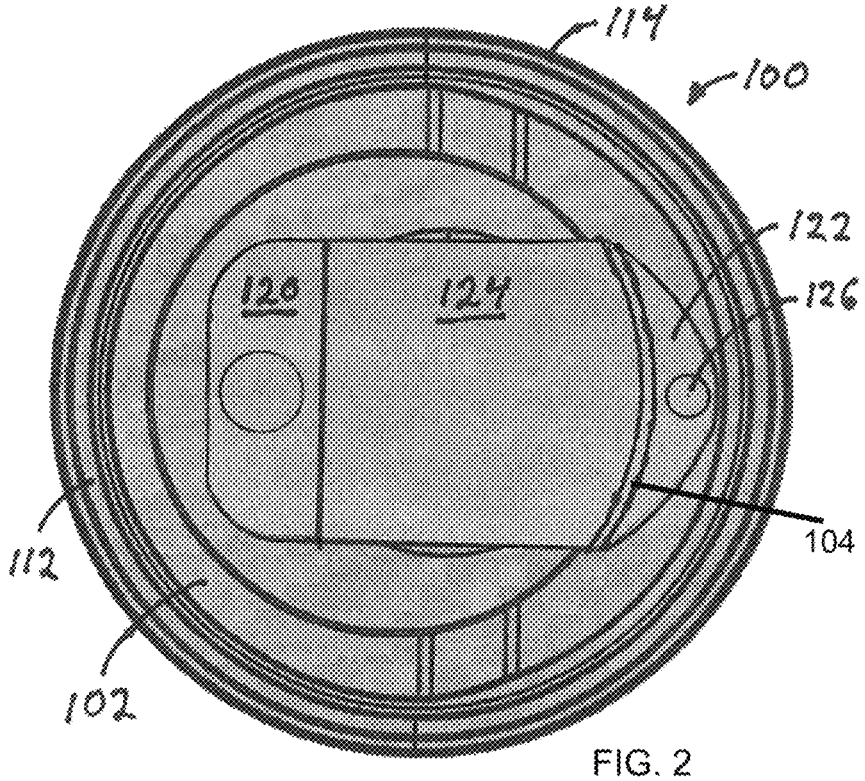
FIG. 2 is a bottom view of the container lid of FIG. 1.

This patent application claims priority from US Provisional Patent Application No.: 62/775,075, filed Dec. 4, 2018, the disclosure of which is incorporated by reference herein in its entirety.

In accordance with various embodiments, an improved container lid 100 for use with a fluid container having a container rim. Exemplary fluid containers for use with the presently disclosed container lids include coffee cups and similar cups produced by a variety of manufacturers. The presently disclosed container lid includes a body member or cover and a cooperative valve that permits a user to temporarily unseal a drinking aperture and, additionally, permits the user to secure or lock the valve in a position that results in the drinking aperture remaining unsealed.

A first embodiment of the container lid 100 having a two-piece design is illustrated in FIGS. 1-4. The container 100 includes a body member or cover 102 and a valve 104 that are formed of a thin, resilient and deformable material. The body member 102 and the valve 104 are formed as separate components using molding, stamping, cutting, forming or other techniques or combinations thereof known in the art.

The body member 102 includes a top surface 106, a bottom surface 108 and a central portion 110 that extends to an outer periphery 112 having an inwardly facing circumferential concave lip 114. The lip 114 is configured to couple to the rim of a fluid container (not shown) upon urging of the lip 114 over the rim of the fluid container. The body member 102 defines a drinking aperture 116 adjacent the outer periphery that permits fluid flow therethrough when the drinking aperture 116 is unsealed. The body member 102 includes an actuator 118 having an actuator top surface 130 and an actuator bottom surface 132. In the illustrated embodiment, the actuator 118 is located generally centrally in the central portion 110 of the body member 102 although the location of the actuator 118 may be varied and configured to be cooperative with the valve 104 to provide the desired unsealing and sealing of the drinking aperture 116 as subsequently described.

The valve 104 includes a first end portion 120, a second end portion 122 and an intermediate portion 124 between the first end portion 120 and the second end portion 122. The second end portion 122 includes a sealing member 126 configured to seal the drinking aperture 116 when the valve 104 is in a free state; e.g., the sealing orientation. The sealing member 126 may be provided as an upwardly extending protuberance that extends through the drinking aperture 116 and, in a sealing orientation, is configured to engage the edge(s) of the drinking aperture 116 so as to occlude and seal the aperture 116. Alternatively, the sealing member may be a generally flat member or any other suitable shape that serves to occlude and seal the aperture when the valve is in the free state.

The first end portion 120 is secured to the bottom surface 108 of the body member 102 so that the sealing member 126 is aligned with the drinking aperture 116 and the actuator bottom surface 132 confronts the intermediate portion 124 of the valve 104. The first end portion 120 of the valve 104 may be secured to the bottom surface 108 of the body member 102 via ultrasonic welding, heat sealing, an adhesive, via staking, via one or more cooperative bosses and recesses or any other suitable attachment technique. The boss(es) may be located on the body member 102 and the recess(es) may be provided in the first end portion 120 or vice versa.

In further embodiments, the valve 104 may be secured to the bottom surface 108 of the body member 102 may be secured at one or more locations, each location secured via ultrasonic welding, heat sealing, an adhesive, via staking, via one or more cooperative bosses and recesses or any other suitable attachment technique.

In some embodiments, the cooperative bosses and recesses of the body member 102 and the valve 104 may include one or more protrusions which interact with the openings of the recesses in order to snap together and secure the valve 104 to the body member 102. As one, non-limiting example, the valve 104 may include an upwardly directed protrusion which snaps into a recess in the bottom side of the body member 102. In another, non-limiting example, the body member 102 includes a downwardly directed protrusion which snaps into an opening in the valve 104. In a further, non-limiting example both the body member 102 and valve 104 include protrusions and corresponding attachment structures (e.g., recesses, opening, etc.).

Figure 3:
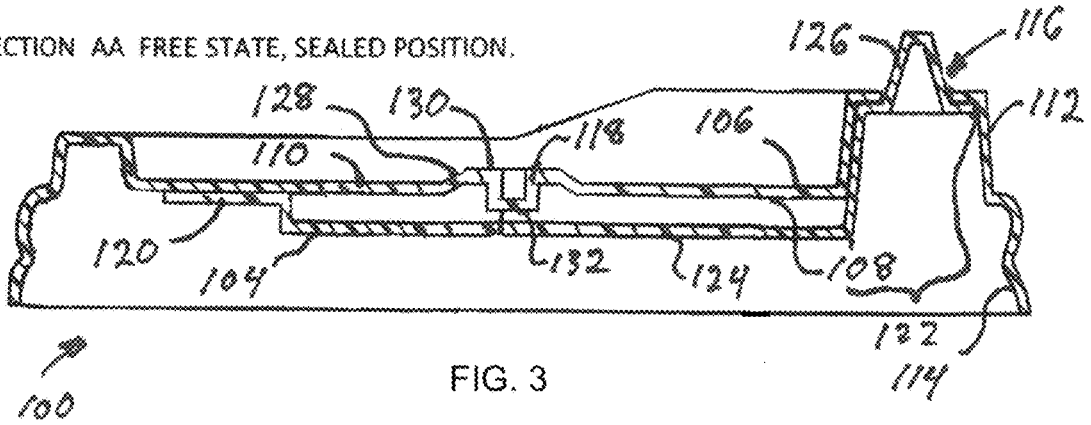
FIG. 3 is a cross-sectional view of the container lid of FIG. 1 illustrating the valve in the sealed or free-state position.

In FIG. 3, the container lid 100 is illustrated in the sealed or free-state orientation in which the sealing member 126 occludes and generally seals the drinking aperture 116. When the first end portion 120 of the valve 104 is secured to the bottom surface 108 of the body member 102, the sealing member 126 is sprung toward the drinking aperture 116 so as to occlude the drinking aperture 116 in the circumstance in which the intermediate portion 124 and the second end portion 122 of the valve are not downwardly deflected by the actuator 118 as subsequently discussed.

Figure 4:
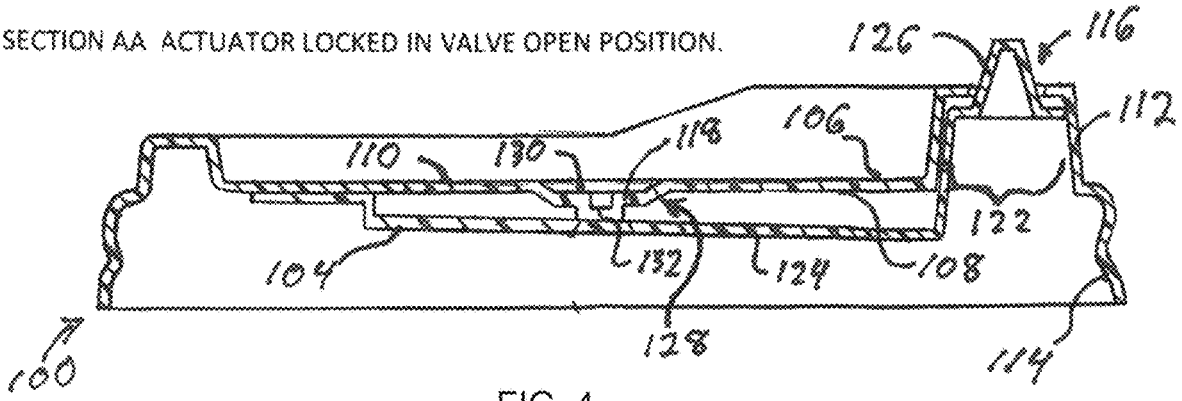
FIG. 4 is a cross-sectional view of the container lid of FIG. 1 illustrating the valve in the unsealed or locked position.

As illustrated in FIG. 4, upon the application of a first mild downward force to the top surface 130 of the actuator 118 from above the top surface 106 of the body member 102, the bottom surface 132 of the actuator 118 moves downward from the free state position and abuts the intermediate portion 124 of the valve 104. In response to the application of the first mild downward force and the downward movement of the actuator 118, the intermediate portion 124 and the second end portion 122, which includes the sealing member 126, deflect downward and thereby unseal the drinking aperture 116. Upon removal of the first mild downward force from the actuator 118, the actuator 118 and the valve 104 return to the free-state position in which the sealing member 126 generally seals the drinking aperture 116.

An area 128 surrounding the actuator 118 is configured so that upon the application of a second sufficient downward manual force that is greater than first mild downward force, the geometric shape formed by the area 128 inverts and the actuator 118 snaps downward into a second valve engagement position. The area 128 surrounding the actuator 118 and the valve 102 remain locked in this position once snapped into the second valve engagement position as illustrated in FIG. 4. In the second valve engagement position the bottom surface 132 of the actuator abuts the intermediate portion 124 of the valve 104, and deflects the second end portion 122 including the sealing member 126 downward. Once the container lid 100 has snapped into the second valve engagement position, the container lid 100 remains locked in this configuration with the drinking aperture 116 unsealed.

The bi-stable nature of the actuator 118 is achieved via the structure of the area 128 surrounding the actuator 118. Specifically, in the exemplary illustrated embodiment, the area 128 surrounding the actuator 118 corresponds to the outer surface of a frustum. As illustrated in FIGS. 1 and 3 in the free-state, the frustum is wider at the base where it connects to the central portion 110 of the body member 102 and narrower at the other end of the frustum where it connects to the actuator 118. Upon the application of the mild downward manual force to the top surface of the actuator 118, the actuator 118 moves downward due in part to the resilient nature of the area 128 surrounding the actuator 118 but returns to the free-state position upon the removal of the mild downward manual force. This characteristic allows the sealing member 126 of the valve 104 to unseal the drinking aperture 116 upon the application of the mild downward manual force and to reseal the drinking aperture 116 upon removal of the first mild downward manual force from the top surface 130 of the actuator 118.

Upon the application of a second sufficient downward manual force that is greater than first mild downward force, the actuator 118 snaps downward into the second valve engagement position in which the frustum surrounding the actuator 118 is inverted and the actuator 118 remains locked in this orientation as illustrated in FIG. 4 due to the bi-stable nature of the area 128 surrounding the actuator 118. In the second valve engagement position the bottom surface 132 of the actuator 118 is disposed at a height lower than its original height and abuts and downwardly deflects the intermediate portion 124 of the valve 104. Once the actuator 118 has snapped into the second valve engagement position, the second end portion 122 of the valve 104 and the sealing member 126 also deflect downward and the sealing member 126 no longer occludes the drinking aperture 116.

As discussed in greater detail below, the outer surface of the area 128 may be frustoconical, frustopyramidal or any other suitable shape that causes the area to invert and remain inverted upon the application of the second sufficient downward force so that the actuator 118 assumes and remains in the second valve engagement position. Thus, upon the application of the second sufficient downward force to the top surface 130 of the actuator 118, the actuator 118 deflects the valve 104 to unseal the drinking aperture 116 and the body member 102 including the actuator 118, the area 128 surrounding the actuator 118 and the valve 104 remain locked in the second valve engagement position due to the configuration of the bi-stable nature of the area 128.

The actuator 118 and the area 128 surrounding the actuator 128 may be constructed so that the area 128 surrounding the actuator 128 is more resilient than the actuator 118. Thus, if a user were to exert a force against the actuator 128 over a region including the area 128, the area 128 could function to prevent deflection of the valve 104. This ensures the user can operate the actuator 128 when desired, for example, only when using the tip of a finger and not accidentally with the palm of their hand. Accordingly, there is a reduced risk that the actuator 128 is inadvertently forced into (and remain in) the second valve engagement position.

In a further non-limiting embodiment, the actuator 118 may include rings which define a central area and an outer ring. If both the central area and the outer ring are pressed together, for example, with the side of a finger, then the actuator 118 may not be pressed far enough to assume the second valve engagement position and will return to the free-state position upon the removal of the pressure. However, if only the central area is pressed, for example, with the tip of a finger, the actuator 118 can reach the second valve engagement position in which the valve remains locked and un-sealed. Therefore, the actuator 118 has a double action—one that is temporary and the other that is permanent. In other embodiments, the structure of the actuator 118 may not be visible, for example, the rings may be invisible with no perceptible delineation between areas.

Figure 5:
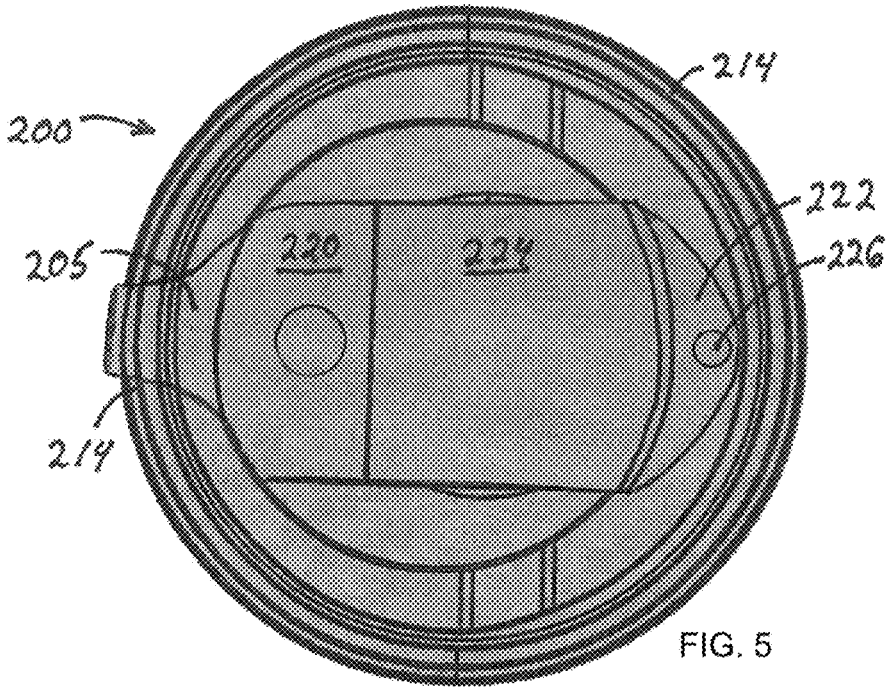
FIG. 5 is a bottom view of a second embodiment of a container lid, the second embodiment having a continuous, one-piece integral design for the body member and valve of the container lid.
Figure 6:
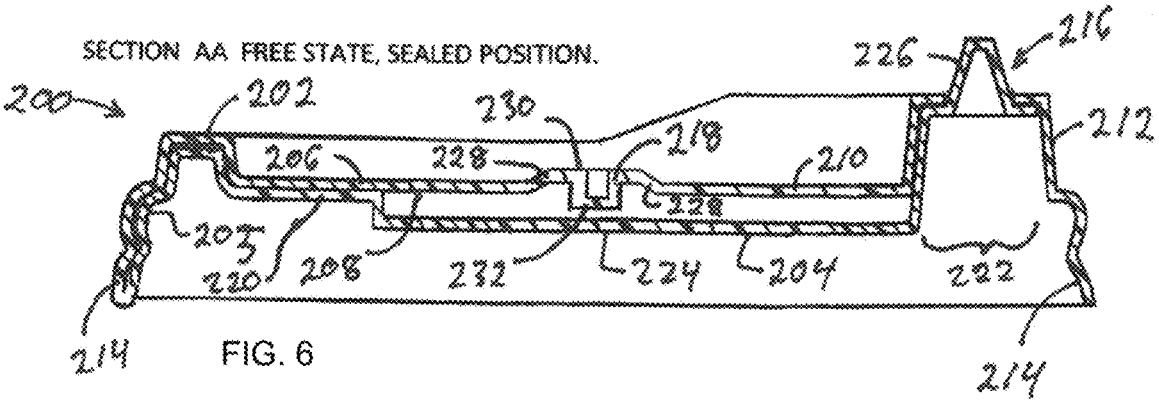
FIG. 6 is a cross-sectional view of the container lid of FIG. 5 illustrating the valve in the sealed or free-state position.
Figure 7:
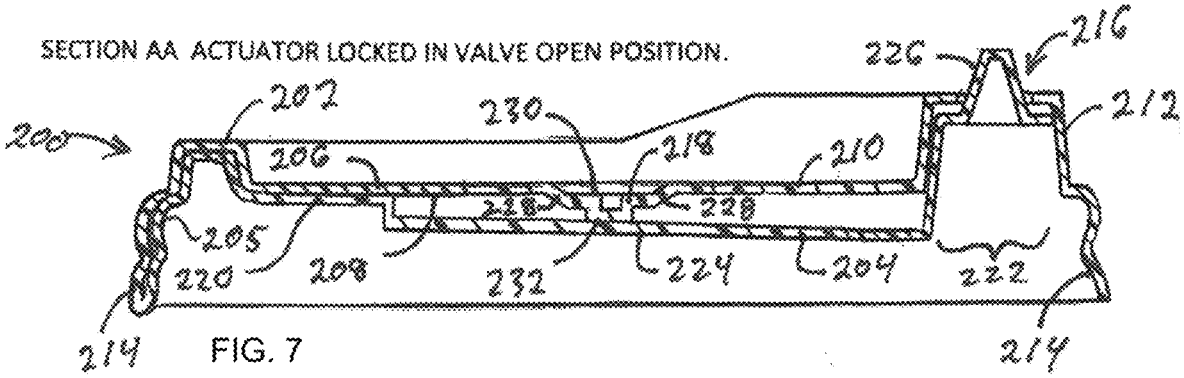
FIG. 7 is a cross-sectional view of the container lid of FIG. 5 illustrating the valve in the unsealed or locked position.

In a second embodiment having a one-piece design illustrated in FIGS. 5-7, a container lid 200 includes a body member 202, a valve portion 204 and an interconnection portion 205 that extends between the body member 202 and the valve portion 204. The body member 202, the valve portion 204 and the interconnection portion 205 are formed as a continuous, one-piece integral unit by one or more molding, stamping, cutting, forming or other operations known in the art.

The body member 202 includes a top surface 206, a bottom surface 208 and a central portion 210 that extends to an outer periphery 212 having an inwardly facing circumferential concave lip 214 configured to couple to a rim of a fluid container (not shown) upon urging of the lip 214 over the rim of the fluid container. The body member 202 defines a drinking aperture 216 adjacent the outer periphery 212. The body member 202 includes an actuator 218 having an actuator top surface 230 and an actuator bottom surface 232. In the illustrated embodiment, the actuator 218 is located generally centrally in the central portion 210 of the body member 202 although the location of the actuator 218 may be varied and configured to be cooperative with the valve 204 to provide the desired unsealing and sealing of the drinking aperture 216.

The valve 204 includes a first end portion 220, a second end portion 222 and an intermediate portion 224 extending between the first end portion 220 and the second end portion 222. The second end portion 222 includes a sealing member 226 configured to seal the drinking aperture 216 when the valve is in a free state; e.g., the sealing orientation. The sealing member 226 may be provided as an upward extending protuberance that extends through the drinking aperture 216 and is configured to engage the edge(s) of the drinking aperture 216 to occlude and seal the drinking aperture 216. Alternatively, the sealing member 226 may be a generally flat member or any other suitable shape that serves to occlude and seal the drinking aperture 216 when the valve 204 is in the free state.

The interconnection portion 205 extends from the lip 214 of the body member 202 to the first end portion 220 of the valve 204. The first end portion 220 of the valve 204 may, in one embodiment, be secured to the bottom surface 208 of the body member 202. In another embodiment, the first end portion is not directly secured to the bottom surface 208 of the body member 202 but is maintained in position upon folding of the interconnection portion 205 against the inner surface of the outer periphery 212 of the body member 202 and mounting of the container lid 200 to the fluid container by urging the lip 214 over the fluid container rim.

The valve 204 is configured such that the sealing member 226 is aligned with the drinking aperture 216 and the bottom surface 232 of the actuator 218 confronts the intermediate portion 224 of the valve 204. The first end portion 220 of the valve 104 may be secured to the bottom surface of the body member 202 via ultrasonic welding, heat sealing, an adhesive, via staking, via one or more cooperative bosses and recesses as discussed above. The boss or bosses may be located on the body member 202 and the recess or recesses may be provided in the first end portion 220 or vice versa. Any other suitable technique may also be employed to secure the first end potion 220 of the valve 204 to the bottom surface 208 of the body member 202.

In FIG. 6, the container lid 200 is illustrated in the sealed or free-state orientation in which the sealing member 226 occludes and generally seals the drinking aperture 216. More specifically, the valve 204 is configured such that when it is secured to the bottom surface 208 of the body member 202, the sealing member 226 is sprung toward the drinking aperture 216 to occlude the drinking aperture 216 in the circumstance in which the intermediate portion 224 and the second end 222 of the valve 204 are not downwardly deflected as discussed hereinabove with respect to FIGS. 1-4. As illustrated in FIG. 6, in the free-state position, an area 228 surrounding the actuator 218 is non-inverted in one of two bi-stable states. When the area 228 surrounding the actuator 218 is non-inverted in the free-state, in the drinking aperture 216 is sealed. FIG. 7 illustrates the presently disclosed one-piece container lid embodiment in which the areas 228 is inverted in the second valve engagement position. The inversion of the area 228 results from the application of the second sufficient downward force on the top surface 230 of the actuator 218. Once the area 228 surrounding the actuator 218 inverts and assumes the position illustrated in FIG. 7, the container lid 200 is locked in the second valve engagement position and the drinking aperture 216 remains unsealed.

Apart from the inclusion of the interconnection portion 205 that allows for production of the container lid as a one-piece integral continuous member as opposed to a container lid formed by affixing a separate valve to the body member, the configuration and operation of the two-piece container lid 100 discussed in connection with FIGS. 1-4 is substantially the same as the configuration and operation of the container lid 200 discussed in connection with FIGS. 5-7. The first end portion 220, in one embodiment is directly secured to the bottom surface 208 of the body member 202. It is noted, however, that in another embodiment of the one-piece container lid that includes the interconnection portion 205, the first end portion 220 of the valve 204 is not directed secured to the bottom surface 208 of the body member 202. Instead, the interconnection portion 205 is folded and formed to confront the bottom surface 208 of the body member 202 upon mounting of the container lid to a fluid container. Upon such mounting, the rim of the fluid container urges the interconnection portion 205 against the inner peripheral edge of the body member 202 to maintain proper alignment of the valve 204 with respect to the bottom surface 232 of the actuator 218 and the drinking aperture 216.

In the first or second embodiments of the container lid discussed hereinabove, the material thickness of the area surrounding the actuator may be generally of the same thickness as the material thickness of the body member. Alternatively, the area surrounding the actuator may be thinner than the surrounding central portion material surrounding to ease the transition from the free-state to the second valve engagement position.

Figure 8:
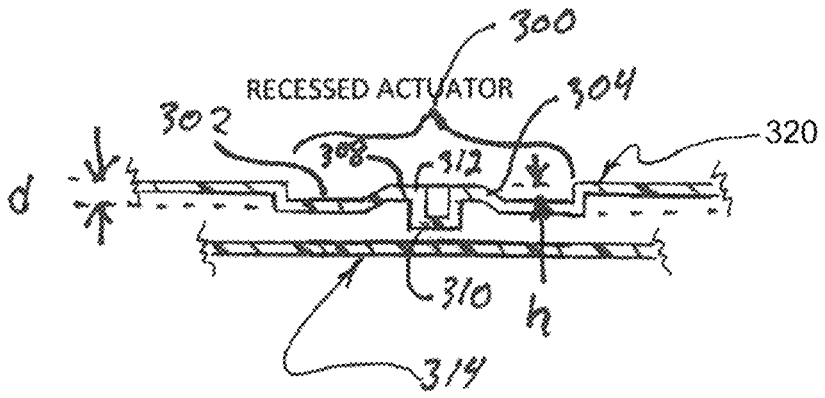
FIG. 8 is a cross-sectional view of a portion an alternative body member design having a recessed central portion in which a top surface of the actuator is at or below the adjacent top surface of the body member.

While the first and second embodiments of a container lid discussed above with respect to FIGS. 1-7 include an actuator having an upper surface that is illustrated as extending above the top surface of the central portion of the body member, in certain circumstances it is desirable for the upper surface of the actuator to be at the same height or below the top surface of the central portion of the body member to avoid the inadvertent locking of the sealing member in an unsealed orientation. As illustrated in FIG. 8, this objective is achieved by providing a recess 300 in the central portion of the body member 320 that extends downward to a recess floor 302. The first end of the area 304 surrounding the actuator 312 extends from the recess floor 302 and the second end of the area 304 surrounding the actuator 312 supports the actuator 312 as discussed above. The height of the top surface 308 of the actuator 312 relative to the top surface of the central portion of the body member 320 may be established based on the depth of the recess "d" and the rise or height of the area "h" from the floor 302 of the recess 300 to the actuator top surface 308. The bottom surface 310 of the actuator 312 is configured to engage and downward deflect the intermediate portion 314 of the valve which may comprise the valve 104 or the valve 108 as described hereinabove above Thus, the recessed actuator illustrated in FIG. 8 that provides for an actuator having a top surface at or below the level of the central portion top surface may be incorporated in either the first or second container lid embodiments discussed hereinabove with respect to FIGS. 1-7.

Figure 9:
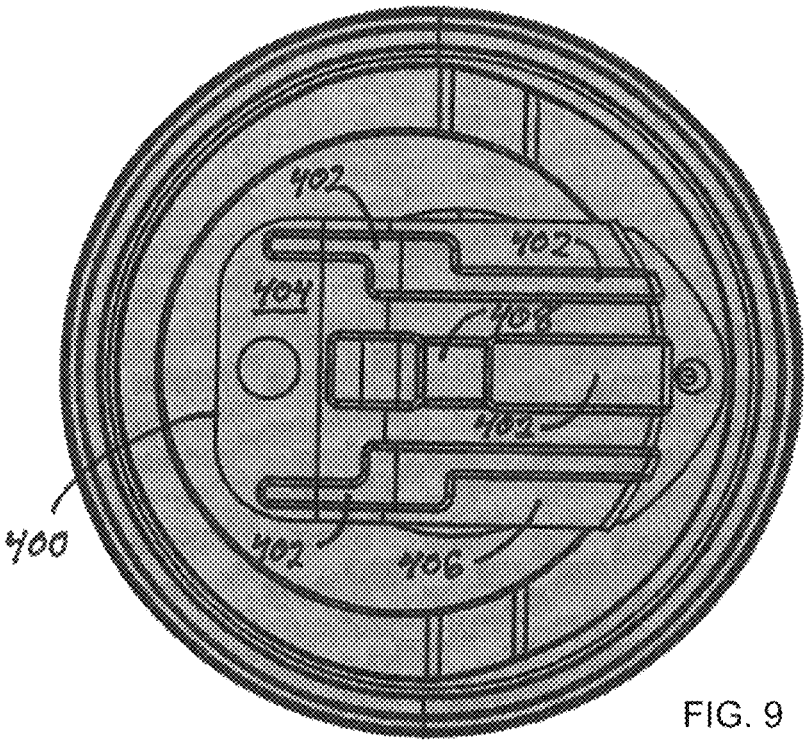
FIG. 9 is a bottom view of an embodiment in which the valve includes longitudinal ribs and an upwardly extending engagement portion.

FIG. 9 is a bottom view of a container lid that depicts a valve 400 that includes optional longitudinally extending ribs 402 along the first end portion 404 and the intermediate portion 406 of the valve 400. The ribs 402 provide longitudinal stiffening of the valve 400 in the respective areas of the valve 400. Additionally, as depicted in FIG. 9, the valve 400 includes a raised actuator engagement portion 408 that extends upward toward the bottom surface of the actuator when the container lid is disposed in a normal use orientation. The raised actuator engagement portion 408 is configured for engagement with the bottom surface of the actuator (not shown in FIG. 9) upon downward deflection of the actuator. The raised engagement portion 408 is configured to provide appropriate spacing with respect the bottom surface of the actuator to obtain desired deflection of the intermediate portion 406 upon the application of an applied downward force to the actuator from above the top surface of the container lid. Though the ribs 402 and the raised actuator engagement portion are illustrated in FIG. 9 on the two-piece container lid of FIGS. 1-4, the ribs 402 and the raised actuator engagement portion 408 may be optionally incorporated in valves of either the two-piece container lid discussed above with respect to FIGS. 1-4 or the one-piece container lid discussed above with respect to FIGS. 5-7.

Figure 10:
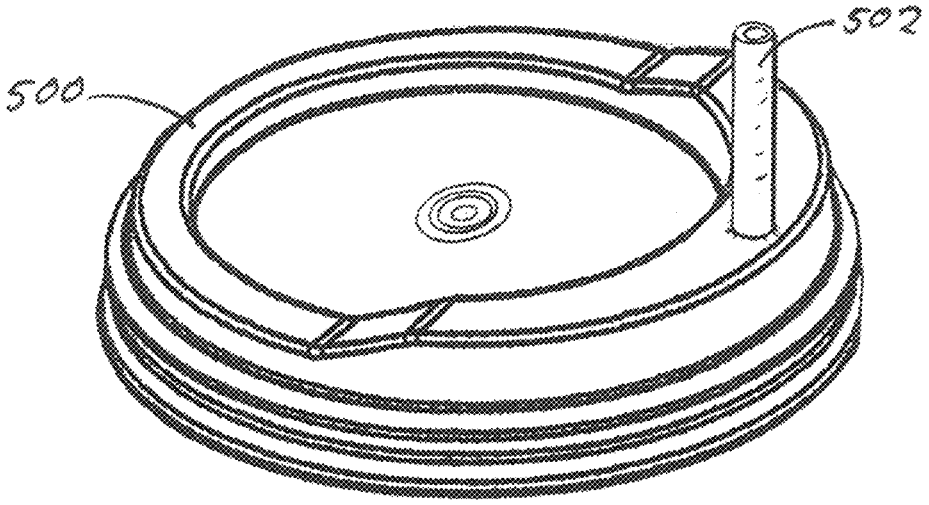
FIG. 10 is a perspective view of an embodiment of a container lid that includes an upwardly extending straw-like member in fluid communication with the drinking aperture.
Figure 11:
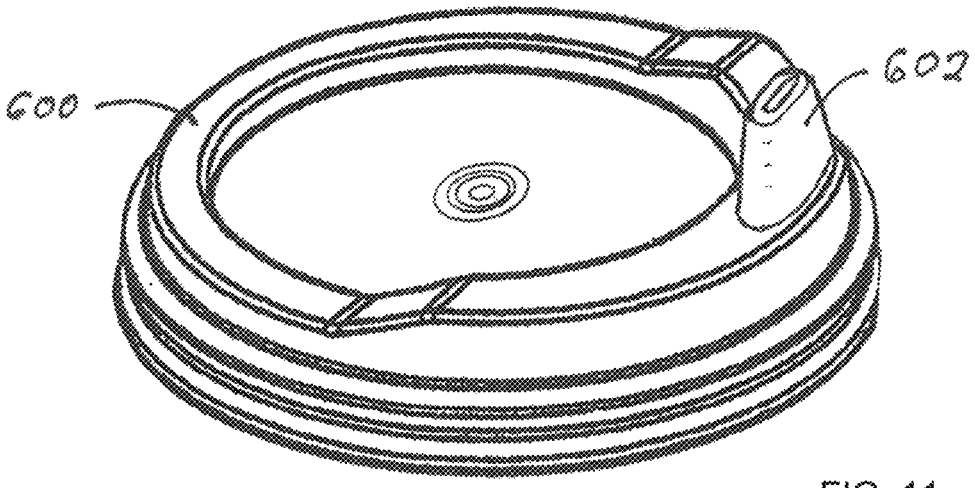
FIG. 11 is a perspective view of an embodiment of a container lid that includes an upwardly extending sipping-spout in fluid communication with the drinking aperture.

FIG. 10 depicts an embodiment of a container lid have a body member 500 that includes a straw-like member 502 formed as an integral, continuous, one-piece structure with the body member 500. FIG. 11 depicts another embodiment of a container lid have a body member 600 that includes a sipping spout 602 formed as an integral, continuous, one-piece structure with the body member 600.

Figure 12:
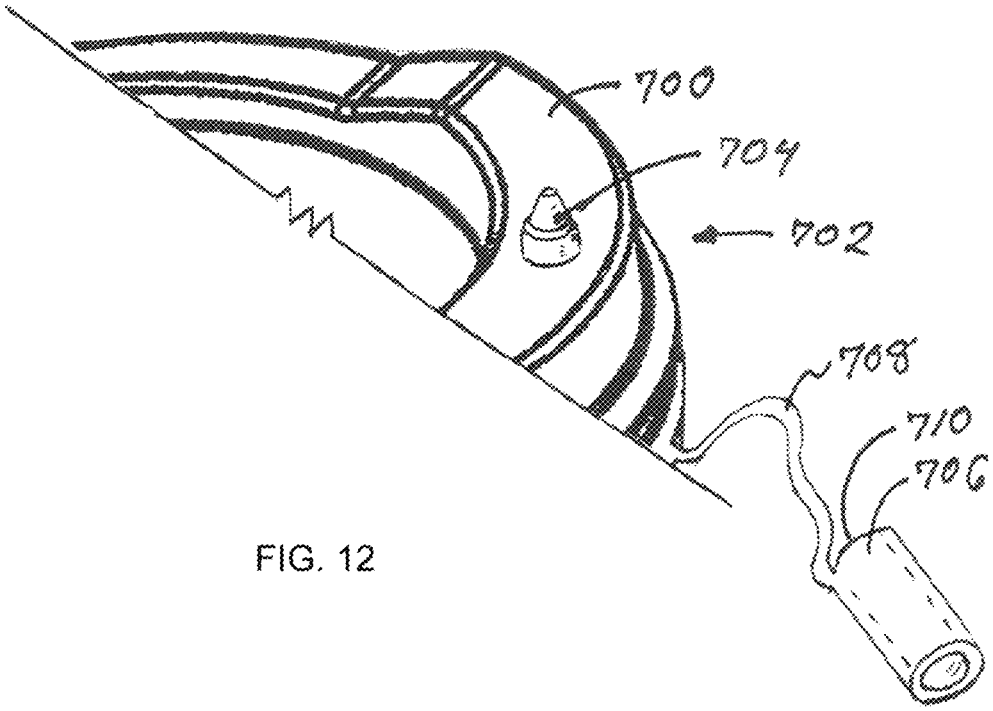
FIG. 12 is a perspective view of a portion of a container lid that includes an upwardly extending spout in fluid communication with the drinking aperture and a straw-like member tethered to the container lid wherein the straw-like member is configured for mounting to the upwardly extending spout.
Figure 13:
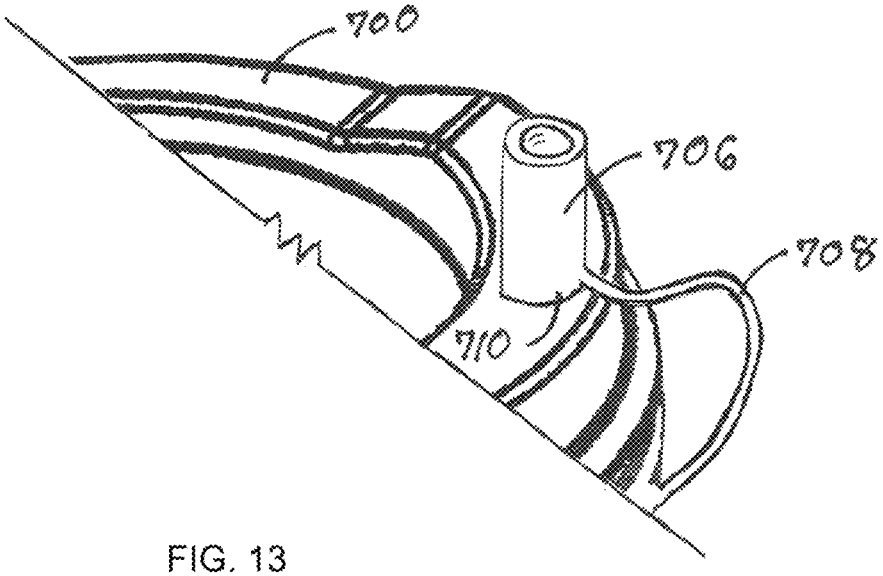
FIG. 13 is a perspective view of the container lid of FIG. 12 in which the straw-like member is mounted on the upwardly extending spout.

FIGS. 12 and 13 illustrate an embodiment of a body member 700 of a container lid 702 that includes an upwardly extending spout 704 formed as an integral, continuous, one-piece structure with the body member 700. The container lid 702 further includes a straw-like member 706 that is coupled to the body member 700 via a tether 708. The straw-like member 706 and the tether 708 may be formed as an integral, continuous, one-piece structure with the body member 700. The cross-section of the upwardly extending spout 704 and the straw-like member 706 are configured and cooperative to permit an end 710 of the straw-like member 706 to be removably mountable over the upwardly extending spout 704 via a press fit as depicted in FIG. 13 to permit drinking through the straw-like member.

In further, non-limiting embodiments, the container lid 702 may include a structure configured for mounting the straw-like member 706 when not being used. This structure may be a non-functioning spout-like protrusion, an elevated ring, or any other structure suitable for removably securing the straw-like member 706. In embodiments where the straw-like member 706 is attached to the container lid 702 via a tether 708, the structure should be within easy reach of the tethered straw-like member 706.

Figure 14:
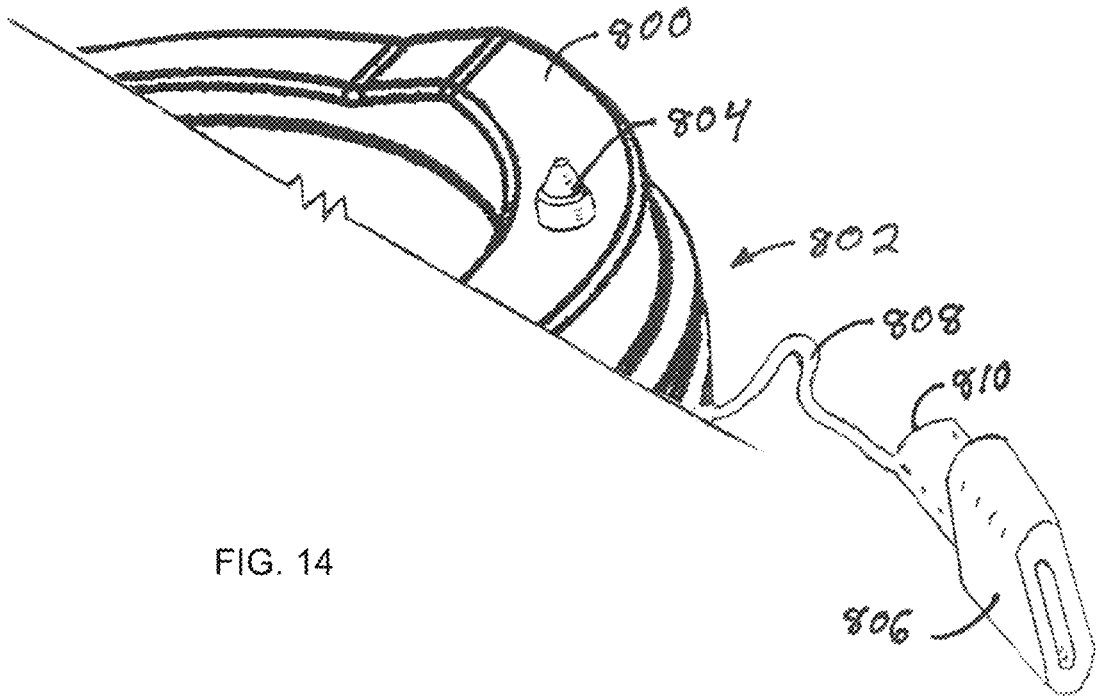
FIG. 14 is a perspective view of a portion of a container lid that includes an upwardly extending spout in fluid communication with the drinking aperture and a sipping-spout tethered to the container lid wherein the sipping-spout is configured for mounting to the upwardly extending spout.
Figure 15:
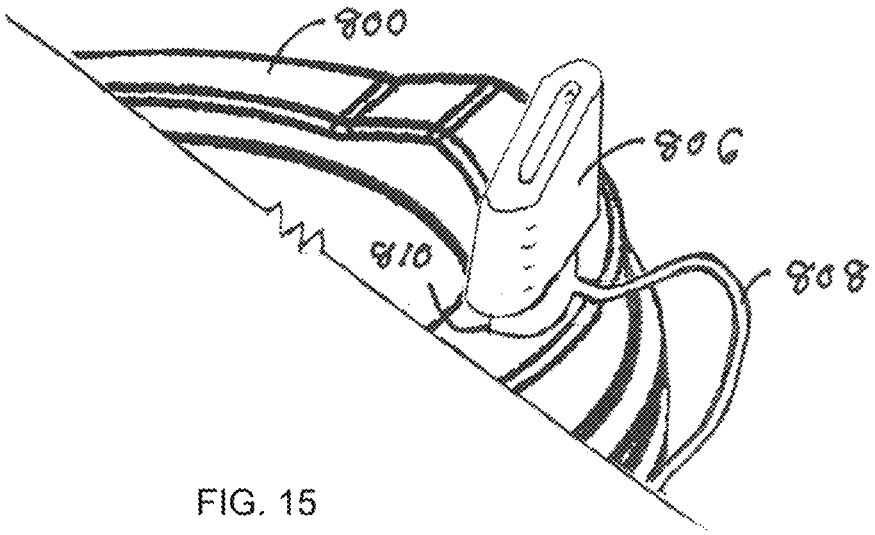
FIG. 15 is a perspective view of the container lid of FIG. 14 in which the sipping-spout is mounted on the upwardly extending spout.

FIGS. 14 and 15 illustrate another embodiment of a body member 800 of a container lid 802 that includes an upwardly extending spout 804 formed as an integral, continuous, one-piece structure with the body member 800. The container lid 802 further includes a sipping-spout 806 that is coupled to the body member 800 via a tether 808. The sipping-spout 806 and the tether 808 may be formed as an integral, continuous, one-piece structure with the body member 800. The cross-section of the upwardly extending spout 804 and the sipping-spout 806 are configured and cooperative to permit an end 810 of the sipping-spout 806 to removably mountable over the upwardly extending spout 804 depicted in FIG. 15 to permit drinking through the sipping-spout.

The size of the opening through the upwardly extending spout 704 or the upwardly extending spout 804 may be specified to accommodate a desired fluid flow therethrough. A user may drink using the container lids illustrated in FIGS. 12-15 directly from the upwardly extending spouts or with the respective straw-like member or sipping-spout mounted on the respective upwardly extended spouts.

The container lids illustrated in FIGS. 10-15 may include the bi-stable actuator mechanism described hereinabove with respect to FIGS. 1-9.

The body members 700, 800 of the container lids depicted in FIGS. 12-15 may optionally include a mount formed in the respective body members that is configured to secure the straw-like member 706 or the sipping spout 806 to the top surface or side portion of the respective body member when not mounted to the respective upwardly extending spout 704, 804.

While tethered spouts in the form of a straw-like member 706 or a sipping spout 806 are depicted in FIGS. 12-15, the tethered spout may take on any suitable shape that is configured for mounting on the upwardly extending spout.

Figure 16:
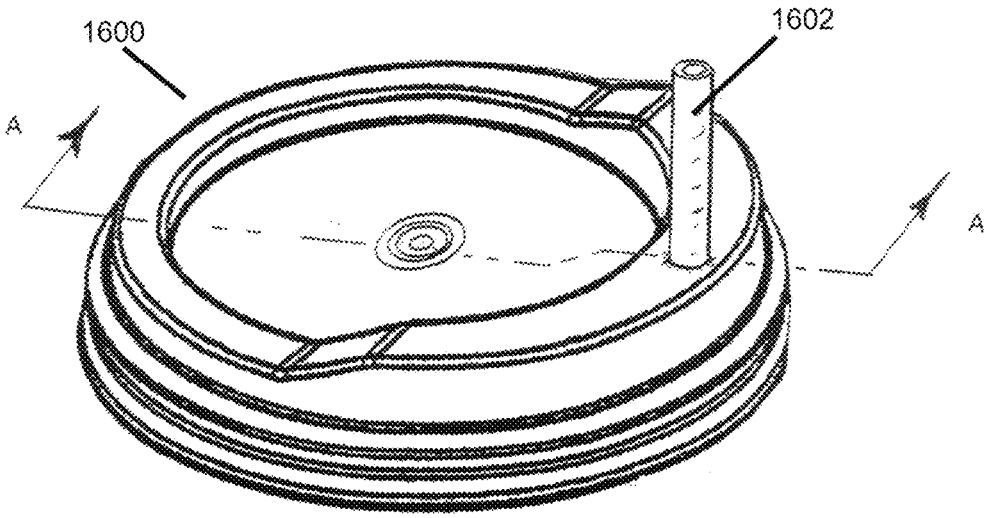
FIG. 16 is a top perspective view of a further embodiment of a container lid that includes an upwardly extending straw-like member in fluid communication with the drinking aperture.

FIG. 16 depicts an embodiment of a container lid 1600 have a body member that includes a straw-like member 1602 formed as an integral, continuous, one-piece structure with the body member 500.

Figure 17:
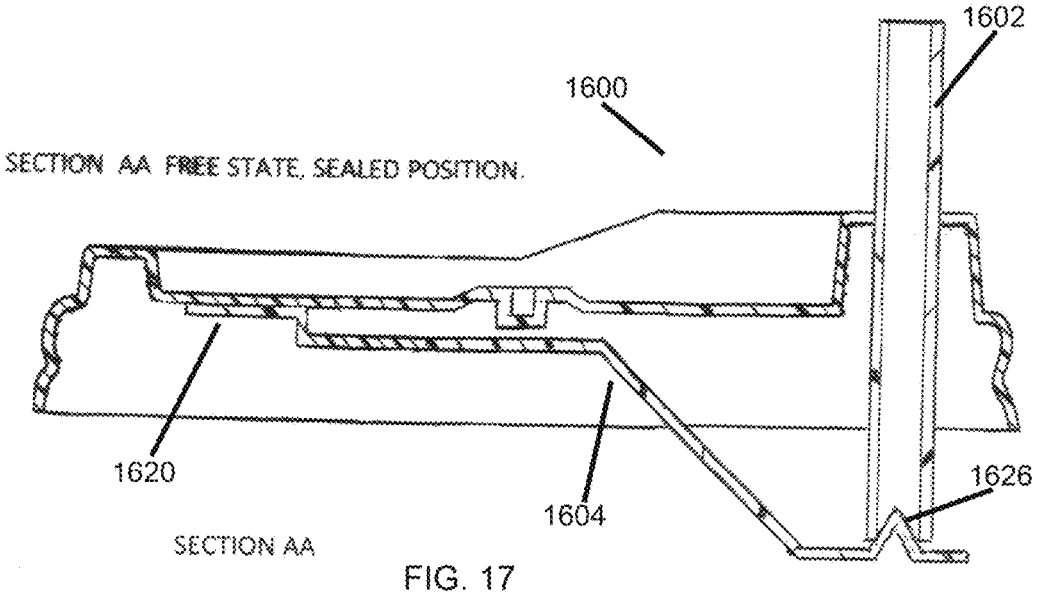
FIG. 17 is a cross-sectional view of the container lid of FIG. 16 illustrating the valve in the sealed or free-state position.

In FIG. 17, the container lid 1600 is illustrated in the sealed or free-state orientation in which the sealing member 1626 occludes and generally seals the bottom of the straw-like member 1602. When the first end portion 1620 of the valve 1604 is secured to the bottom of the straw-like member 1602, the sealing member 1626 is sprung upwards into the straw-like member 1602 so as to occlude the straw-like member 1602 and prevent liquid from entering.

Figure 18:
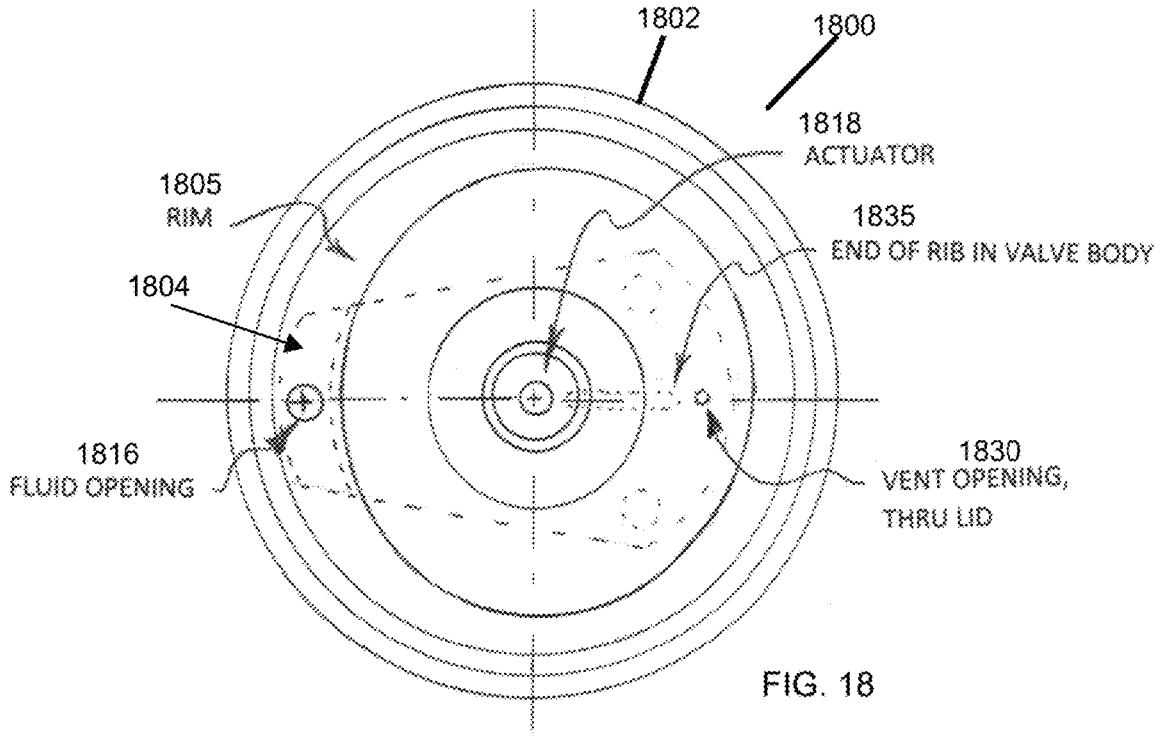
FIG. 18 is a top view of another embodiment of a container lid that includes a vent.
Figure 19:
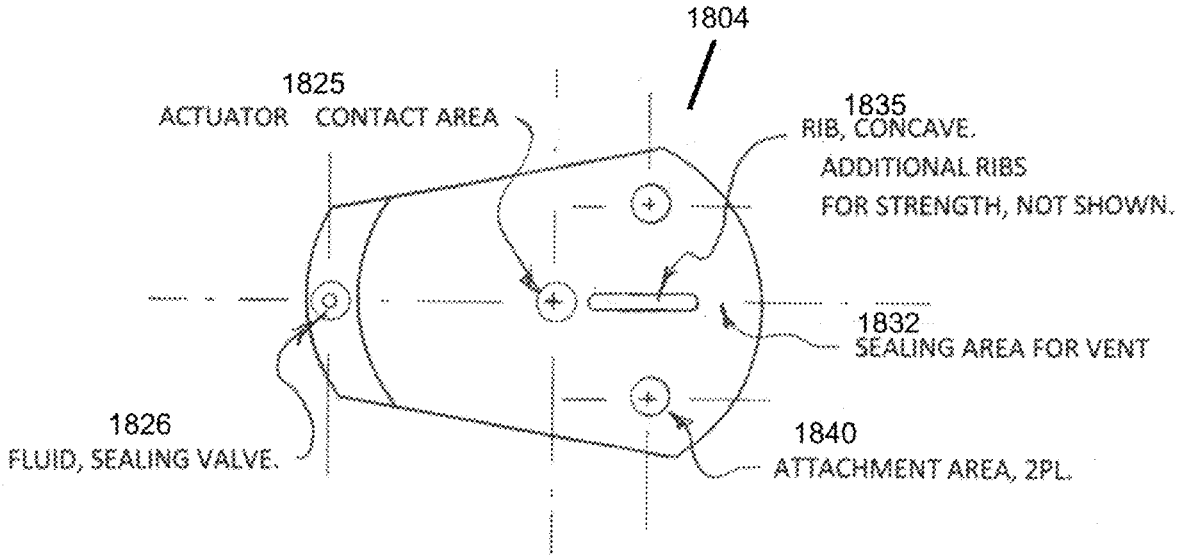
FIG. 19 is a top view of the valve portion of the container lid of FIG. 18.

FIG. 18 is a top view of another embodiment of a container lid 1800 having a body member 1802 and valve portion 1804. The valve portion 1804 is shown inside of dashed lines surrounding the valve portion configuration where it would be attached to the underside of the container lid 1800 in order to demonstrate the relative positions of the various features of the assembled container lid 1800. FIG. 19 is a top view of the valve portion 1804 of the container lid 1800 of FIG. 18.

In this embodiment of the container lid 1800 includes a body member 1802 having a rim 1805 with a fluid opening 1816 for drinking. The body member 1802 includes an actuator 1818. In the illustrated embodiment, the actuator 1818 is located generally centrally in the body member 1802 although the location of the actuator 1818 may be varied and configured to be cooperative with the valve 1804 to provide the desired unsealing and sealing of the drinking aperture 1816.

The body member 1802 also defines a vent opening 1830 through which, when open, air may enter the container, for example, to prevent creation of a vacuum within the container. The vent opening 1830 may be located so as to operate with the valve portion 1804 to prevent unwanted spills, such as when a liquid within the container leaks out of the vent opening 1830.

Additionally, the valve portion 1804 may include a concave rib 1835 which both provides increased strength to the valve portion 1804 and directs air flowing in through the valve portion 1824.

In further embodiments, one or more vent opening 1830 may be located within the body member 1802. Each vent opening 1830 may operate with an associated concave rib 1835 or multiple vent openings 1830 may operate with a single concave rib 1835. The rib 1835 may direct air flow towards the sealing valve 1826 or towards the general interior of the container.

As shown, the valve portion 1804 includes an actuator contact area 1825 configured to operate with the actuator 1818 of the body member 1802. The valve portion 1804 also includes two attachment areas 1840 where the valve portion 1804 is secured to the body member 1802. In other non-limiting embodiments, there may be one attachment area 1840 or more than two attachment areas 1840.

When using other embodiments, such as one-piece design for both the body member 202 and the valve portion 204 (as shown in FIGS. 5-7), the interconnection portion 205 may provide sufficient attachment when mounted on a fluid container rim so that there may be no attachment areas as in the two-piece design. However, one or more attachment areas may also be provided for the one-piece design, for example, to ensure proper alignment of the body member 202 and the valve portion 204.

The valve portion 1804 has one or more ribs 1835. For each vent opening 1835, the valve portion 1804 includes a sealing area 1832 configures to seal the vent opening 1835 when in the sealed or free-state orientation. When the actuator 1818 is used, and the sealing valve 1826 is emitting fluid at the fluid opening 1816, the vent is also opening. Therefore, the air vent opens and closes simultaneously with the fluid opening operation. Also, the vent location may be relocated or eliminated in order to suit various design choices.

While the exemplary embodiments illustrated herein depict the use of a frustum shaped area surrounding an actuator to provide bi-stable operation of the valve, the area surrounding the actuator may have any geometric shape that provides the above-described bi-stable operation. More specifically the area surrounding the actuator may have any shape that produces temporary unsealing of the drinking aperture in response to the application of the first downward manual force to the actuator from the top surface of the body member and provides for resealing of the drinking aperture upon removal of the first mild downward force and, additionally, in response to the application to the actuator from the top surface of the body member of a second sufficient downward manual force that is greater than the first downward manual force results in the inversion of the area surrounding the actuator such that the surrounding area remains inverted after removal of the second downward manual force. The inversion of the area surrounding the actuator results in the downward deflection of the intermediate portion valve as described hereinabove and effectively locks the valve in the unsealed orientation. By way of example, and not limitation, the area surrounding the actuator may have also have a shape corresponding to a frustum having a stepped outer surface, a dome shaped surface, a surface having concave outwardly facing sides or any other suitable geometric shape that provides the above-described bi-stable operation.

By way of example and not limitation, the body member, valve, and interconnection formed (when present) may be formed of any thin, flexible and resilient material, such as a plastic (e.g. polystyrene), cellulose, a bio-degradable material, such as a soy or other plant based material, or from a suitable low-cost material suitable for single use applications such as for disposable coffee cup lids. Alternatively, the body member, valve and interconnection portion (when present) may be fabricated from a metal, such as a thin, resilient and deformable stainless-steel or any other suitable metal.

While the illustrated embodiment employs a button as the actuator, the actuator may comprise an actuator region in the form of a flattened portion of the central portion of the body member, or a depression or recessed region that is supported by the area surrounding the actuator region.

The desired operation of the actuator and valve in response to a force applied to the actuator may be achieved by appropriate thinning and thickening of selected regions of the body member including but not limited to the area surrounding the actuator, the valve and/or the interconnection portion (when present).

As described hereinabove, the drinking aperture of the presently disclosed container lid may be temporarily unsealed or alternatively, unsealed in a manner in which the drinking aperture remains unsealed due to the bi-stable nature of the actuator mechanism. However, it should be noted that a user who has caused the actuator mechanism to assume the second valve engagement position in which the drinking aperture remains unsealed, may remove the container lid from the drinking container after securing the valve in the second valve engagement position and apply an upward force to the bottom surface of the intermediate portion of the valve which in turn will cause the area surrounding the actuator and the actuator to once again assume the free-state orientation in which the drinking aperture is sealed by the sealing member.

While the above-described embodiments illustrate container lids having a non-threaded lip configured to be urged over the rim of a drinking container to mount the container lid to the drinking container, alternatively, the above-described embodiments may include circumferential threads at the lower end of the outer periphery of the container lid to permit the container lid to be screwed on to a drinking container having cooperative circumferential threads at the upper extent thereof to mount the container lid to the drinking container.

It will be appreciated that modifications to and variations of the above-described container lid may be made without departing from the inventive concepts described herein. Accordingly, the invention is not to be viewed a limited except by the scope and spirit of the appended claims.

What is claimed is:

1. A container lid for mounting to a fluid container comprising:

a body member formed as a unitary, single piece, continuous member of a resilient material, the body member having a top surface, a bottom surface and a peripheral edge, the body member including a central portion, an actuator having a top surface and a bottom surface, and an area surrounding the actuator extending from and connecting the central portion to the actuator, the body member further including a drinking aperture adjacent the peripheral edge, wherein the area surrounding the actuator has a first stable state in which the bottom surface of the actuator is disposed at a first level relative to the central portion of the body member and a second stable state in which the area surrounding the actuator in generally inverted relative to the first stable state and the bottom surface of the actuator is disposed as a second level relative to the central portion that is lower than the first level when the container lid is mounted to the fluid container in its normal use orientation; and a valve formed as a unitary, single piece, continuous member of a resilient material, the valve having a first end portion, a second end portion including a sealing member and an intermediate portion extending between the first end portion and the second end portion, the first end portion being coupled to the body member to permit the second end portion and the sealing member to be downwardly deflected in response to the downward deflection of the intermediate portion of the valve, wherein:

the valve being a spring-like member configured to urge the sealing member in sealing engagement with the drinking aperture to generally seal the drinking aperture in a sealing orientation in the absence of an application of downward manual force to the actuator from above the top surface of the body member;

in response to an application of a first downward manual force to the top surface of the actuator when the area surrounding the actuator is in the first stable state, the area surrounding the actuator is configured to deform to permit the bottom surface of the actuator to move downward and deflect the intermediate portion and the second end portion of the valve to cause the sealing member to be spaced from the drinking aperture in an unsealed orientation to permit fluid flow through the drinking aperture, and in response to removal of the first downward manual force, the area surrounding the actuator is configured to reassume the first stable state and the valve is configured to reassume the sealing orientation, and in response to an application to the top surface of the actuator of a second sufficient downward manual force that is greater than the first downward manual force the area surrounding the actuator is configured to assume the second stable state in which the bottom surface of the actuator abuts the intermediate portion of the valve and downwardly deflects the intermediate portion and the second end portion of the valve such that the sealing member assumes and remains in the unsealed orientation in which the sealing member is spaced from the drinking aperture to permit fluid flow therethrough.

2. The container lid of claim 1, wherein the first end portion is directly affixed to the bottom surface of the body member.

3. The container lid of claim 1, wherein the area surrounding the actuator is frustoconical.

4. The container lid of claim 1, wherein the area surrounding the actuator is frustopyramidal.

5. The container lid of claim 1, wherein the body member includes a peripheral lip configured to mount to a rim of the fluid container upon urging of the peripheral lip over the fluid container rim and an interconnection portion extending between the peripheral lip of the body member and the first end portion of the valve.

6. The container lid of claim 5, wherein the body member, the valve and the interconnection portion are a continuous, one-piece, integral member.

7. A container lid configures to mount to a fluid container comprising:

a body member formed of a resilient material, the body member including an actuator, and an area surrounding the actuator, the body member defining a drinking aperture adjacent a peripheral edge, wherein the area surrounding the actuator has a first stable state in which a bottom surface of the actuator is disposed at a first level and a second stable state in which the area surrounding the actuator in generally inverted relative to the first stable state and the bottom surface of the actuator is disposed as a second level that is lower than the first level; and a valve formed of a resilient material, the valve including a sealing member, the valve being coupled to the body member to permit the sealing member to be downwardly deflected in response to a downward deflection of the valve, wherein:

the valve being a spring-like member configured to urge the sealing member in sealing engagement with the drinking aperture to generally seal the drinking aperture in a sealing orientation in the absence of an application of downward manual force to the actuator;

in response to an application to the actuator of a first downward manual force when the area surrounding the actuator is in the first stable state, the area surrounding the actuator is configured to temporarily deform to permit the actuator to move downward and deflect the valve to cause the sealing member to be spaced from the drinking aperture in an unsealed orientation, and in response to removal of the first downward manual force, the area surrounding the actuator is configured to reassume the first stable state and the valve is configured to reassume the sealing orientation, and in response to an application to the actuator of a second downward manual force that is sufficiently greater than the first downward manual force the area surrounding the actuator is configured to assume the second stable state in which the actuator abuts the valve and downwardly deflects the valve such that the sealing member assumes and remains in the unsealed orientation.

8. The container lid of claim 7, wherein the valve is directly affixed to a bottom surface of the body member.

9. The container lid of claim 7, wherein the body member includes a peripheral lip configured to mount to a rim of the fluid container upon urging of the peripheral lip over the fluid container rim and an interconnection portion extending between the peripheral lip of the body member and the valve.

10. The container lid of claim 7, wherein the body further comprises a mouth piece, the mouth piece defining the drinking aperture.

11. The container lid of claim 7, wherein the body member further comprises a mounting point defining the drinking aperture and configured to connect a removable mouth piece.

12. The container lid of claim 11, wherein the removable mouth piece is one of: an oval spout, and a round straw.

13. The container lid of claim 12, wherein the removable mouth piece is connected to the container lid via a tethering member.

14. The container lid of claim 12, wherein the body member further comprises a non-functional mounting point configured to retain the removable mouth piece.

15. The container lid of claim 7, wherein the drinking aperture comprises straw-like member which extends into the fluid container and the sealing member is configured to sealingly engage with a lower end of the straw-like member.

16. The container lid of claim 7, wherein the body member further defines at least one vent opening configured to allow air flow into the fluid container.

17. The container lid of claim 16, wherein, when in the sealing orientation, the valve seals the at least one vent opening and, when in the unsealed orientation, the valve is spaced from the at least one vent opening.

18. The container lid of claim 7, wherein the body member further comprises at least one rib structure.

19. The container lid of claim 18, wherein the at least one rib structure is configured to provide additional structural support to the body member.

20. The container lid of claim 18, wherein the body member further defines at least one vent opening configured to allow air flow through the at least one rib structure into the fluid container.

21. The container lid of claim 7, wherein the actuator and the area surrounding the actuator are configured to receive the second downward manual force at a restricted area such that the second downward manual force when applied within the restricted area causes the area surrounding the actuator to assume the second stable state, and configured such that a force applied at least partially outside the restricted area allows the area surrounding the actuator to assume the first stable state while preventing the area surrounding the actuator to assume the second stable state.

22. The container lid of claim 7, wherein the body member and the valve are a continuous, one-piece, integral member, wherein the continuous, one-piece, integral member includes an interconnection portion between the body member and the valve, and wherein, when the container lid is mounted onto a rim of a fluid container, the rim is in contact with the interconnection portion such that the body member and the valve are maintained in relative position.

* * * * *